US009616467B2

(12) United States Patent
Lin et al.

(10) Patent No.: US 9,616,467 B2
(45) Date of Patent: Apr. 11, 2017

(54) CLEANING APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zijin Lin, Beijing (CN); Yaowei Wang, Beijing (CN); Yinghua Tian, Beijing (CN); Kuo Chang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 289 days.

(21) Appl. No.: 14/360,883

(22) PCT Filed: Oct. 16, 2013

(86) PCT No.: PCT/CN2013/085295

§ 371 (c)(1),
(2) Date: May 27, 2014

(87) PCT Pub. No.: WO2014/183376

PCT Pub. Date: Nov. 20, 2014

(65) Prior Publication Data

US 2015/0135452 A1 May 21, 2015

(30) Foreign Application Priority Data

May 16, 2013 (CN) ..... 2013 1 0181062

(51) Int. Cl.
*B08B 1/00* (2006.01)
*B08B 5/04* (2006.01)
(Continued)

(52) U.S. Cl.
CPC ..... *B08B 1/006* (2013.01); *A47L 11/408* (2013.01); *A47L 11/4047* (2013.01); *B08B 1/00* (2013.01);
(Continued)

(58) Field of Classification Search
CPC B08B 1/00; B08B 1/001; B08B 1/003; B08B 1/006; B08B 1/02; B08B 1/04;
(Continued)

(56) References Cited

U.S. PATENT DOCUMENTS 3,418,673 A * 12/1968 Kruth ..... B43L 21/02 15/118
3,816,868 A * 6/1974 Dotsko ..... A47L 1/02 134/21
(Continued)

FOREIGN PATENT DOCUMENTS

CN 2081708 U 7/1991
CN 2322706 Y 6/1999
(Continued)

OTHER PUBLICATIONS

Partial machine translation of JP 2002-186923, Jul. 2, 2002.*
(Continued)

*Primary Examiner* — Mark Spisich
(74) *Attorney, Agent, or Firm* — Ladas & Parry LLP

(57) ABSTRACT

The present invention provides a cleaning apparatus including at least one dust particulate absorber device(s) and a wiper device. The at least one dust particulate absorber device(s) is used for absorbing foreign matters, the wiper device is used for wiping and cleaning, and the dust particulate absorber device(s) and the wiper device are arranged in the horizontal direction.

10 Claims, 2 Drawing Sheets

(51) Int. Cl.

| | |
|---|---|
| ***A47L 11/40*** | (2006.01) |
| ***B08B 7/04*** | (2006.01) |
| ***B08B 1/02*** | (2006.01) |
| *A47L 11/20* | (2006.01) |
| *A47L 9/08* | (2006.01) |

(52) U.S. Cl.
CPC ..... *B08B 1/008* (2013.01); *B08B 1/02* (2013.01); *B08B 5/04* (2013.01); *B08B 7/04* (2013.01); *A47L 9/08* (2013.01); *A47L 11/201* (2013.01)

(58) Field of Classification Search
CPC .. B08B 2/00; B08B 2/02; B08B 2/024; B08B 5/00; B08B 5/02; B08B 5/023; B08B 5/04; B08B 5/043; B08B 5/026; B08B 5/046; B08B 7/00; B08B 7/04; B08B 11/00; A47L 1/00; A47L 1/02; A47L 1/05; A47L 5/00; A47L 5/14; A47L 9/00; A47L 9/02; A47L 9/08; A47L 11/00; A47L 11/02; A47L 11/03; A47L 11/04; A47L 11/10; A47L 11/20; A47L 11/201; A47L 11/2829; A47L 11/30; A47L 11/4036; A47L 11/4047; A47L 11/408
USPC ..... 15/4, 97.1, 98, 99, 100, 102, 103, 103.5, 15/104.002, 105, 118, 302, 320, 321, 345, 15/403
See application file for complete search history.

(56) References Cited

U.S. PATENT DOCUMENTS

| | | | | |
|---|---|---|---|---|
| 4,369,544 | A * | 1/1983 | Parisi | A47L 11/30 15/320 |
| 4,433,451 | A | 2/1984 | Parisi | |
| 5,220,703 | A | 6/1993 | Kanayama et al. | |
| 5,327,609 | A | 7/1994 | Bierma et al. | |
| 6,966,098 | B2 * | 11/2005 | Sako | A47L 5/28 15/231 |
| 2003/0033681 | A1 | 2/2003 | Blum et al. | |
| 2003/0204923 | A1 * | 11/2003 | Nakamura | A46B 13/02 15/4 |
| 2004/0134025 | A1 * | 7/2004 | Murphy | A47L 5/24 15/403 |
| 2012/0110755 | A1 * | 5/2012 | Liu | A47L 11/4013 15/1.51 |

FOREIGN PATENT DOCUMENTS

| | | | | |
|---|---|---|---|---|
| CN | 201482771 | U | | 5/2010 |
| CN | 201641876 | U | | 11/2010 |
| CN | 202803643 | U | | 3/2013 |
| CN | 103316868 | A | | 9/2013 |
| DE | 102006061209 | | * | 6/2008 |
| JP | 6174672 | A | | 4/1986 |
| JP | 01-310780 | A | | 12/1989 |
| JP | 0347229 | A | | 2/1991 |
| JP | 2001-340270 | | * | 12/2001 |
| JP | 2002-186923 | | * | 7/2002 |
| JP | 3477948 | B2 | | 10/2003 |
| JP | 2007-190258 | | * | 8/2007 |
| JP | 2008-36189 | | * | 2/2008 |
| WO | 95/28869 | | * | 11/1995 |

OTHER PUBLICATIONS

Partial machine translation of JP 2007-190258, Aug. 2, 2007.*
International Search Report dated Jul. 1, 2014; PCT/CN2013/085295.
Second Chinese Office Action dated Dec. 29, 2014; Appln. No. 201310181062.2.
International Preliminary Report on Patentability Appln. No. PCt/CN2013/085295; Dated Nov. 17, 2015.
Chinese Patent Certificate Appln. No. 1872568; Dated Dec. 9, 2015.
First Chinese Office Action Appln. No. 201310121062.2; Dated Aug. 29, 2014.

* cited by examiner

CLEANING APPARATUS

TECHNICAL FIELD

The embodiment of present invention relates to a cleaning apparatus, and to a cleaning apparatus for cleaning a work table.

BACKGROUND

In the current technology in detecting the display panel, the cleanliness of the work table for detecting can significantly affect the detecting results, and even very tiny dust on the work table could affect the detecting results, which may cause false defection. In addition, if there are foreign matters, for example scraps, on the work table, the display panel may also be caused into breakage, which would result in heavy losses.

Existing work tables are mainly wiped to clean the same through manual work. During cleaning process, it's required for the staff to enter the apparatus. However, on one hand, it's inconvenient for the staff to work within the apparatus due to the limited inner space of the apparatus, and there are lots of connecting wires and air tubes within the interior of the apparatus, which are subjected to the risk of damage because of being stepped on by the staff. On the other hand, the staff is required to enter the apparatus frequently, which readily causes increase of the dust particulates inside the apparatus, and further, the staff is subjected to potential safety problems when staying within the apparatus.

SUMMARY

An embodiment of present invention provides a cleaning apparatus capable of cleaning the work table instead of manual work.

The embodiments of present invention are implemented with the following technical solution.

The embodiment of present invention provides a cleaning apparatus comprising at least one dust particulate absorber device and a wiper device arranged in a horizontal direction, wherein the at least one dust particulate absorber device is used for absorbing foreign matters, the wiper device is used for wiping.

For example, in another embodiment of the present invention, the wiper device comprises two accommodation chambers, each of which is provided with one roller, a sheet of non-dust cloth having its two ends wound around the two rollers respectively, and at least covering the bottom portion of the cleaning apparatus, wherein the roller in one of the accommodation chambers is a driving shaft.

For example, in another embodiment of the present invention, several transfer shafts are provided between the two rollers for feeding the non-dust cloth.

For example, in another embodiment of the present invention, the cleaning apparatus further comprises an electrical motor module to drive the driving shaft.

For example, in another embodiment of the present invention, a resilient means is mounted at the bottom of the cleaning apparatus, and the non-dust cloth overlies the resilient means.

For example, in another embodiment of the present invention, at the opposite sides of the wiper device are respectively provided with one of the at least one dust particulate absorber device.

For example, in another embodiment of the present invention, the cleaning apparatus further comprises at least one airdry device, which is arranged side by side with respect to the wiper device and the at least one dust particulate absorber device, wherein at the two opposite sides of the wiper device are respectively provided with one of the at least one airdry device.

For example, in another embodiment of the present invention, the at least one dust particulate absorber device is communicated with the outer side of the cleaning apparatus so as to remove the absorbed dust particulates outside of the cleaning apparatus.

For example, in another embodiment of the present invention, the cleaning apparatus further comprises a control circuit for controlling the operation of each component of the cleaning apparatus.

For example, in another embodiment of the present invention, the cleaning apparatus further comprises a fixture member for retaining the cleaning apparatus.

The embodiment of present invention provides a cleaning apparatus comprising at least one dust particulate absorber device and a wiper device, the at least one dust particulate absorber device primarily works to remove the foreign matters on the work table, then the wiper device works to further clean the work table, thus such a cleaning apparatus may clean the work table instead of manual work, so as to avoid various potential risks of safety and damage to the apparatus as a result of manual cleaning, and further, the cleaning quality is ensured.

BRIEF DESCRIPTION OF THE DRAWINGS

In the following, a brief introduction of the drawings of the embodiment of present invention will be given so as to describe the technical solutions of the embodiments more clearly, and it's obvious that the drawings described hereinafter just concern some embodiments of the present invention, rather than limitation to the present invention.

DETAILED DESCRIPTION

A clear and complete description of the technical solutions of the embodiments of present invention will be made in conjunction with the drawings of the embodiments of present invention, and obviously, the described embodiments are only part of the embodiments for the present invention, rather than all the embodiments. Based on the embodiments of the present invention, all the other embodiments obtained by the ordinary skilled in this art without any creative endeavors fall into the protective scope of the present invention.

Unless defined otherwise, the technical terms or scientific terminology being used should take the meaning usually understood by the ordinary skilled in this art of present invention. The "first", "second" and similar words used in the description and claims of the present application does not denote any sequence, quantity or importance, but are used for distinguishing different components. Also, "one" or "a(an)" and the similar words do not mean quantitative restriction, but refer to the presence of at least one. Wording "including" or "comprising" and similar words means that element elements or articles before this word encompass the elements or articles and their equivalents listed after this word, rather than excluding other elements or articles. The "Coupling" or "coupled with" and the similar words are not limited to physical or mechanical connections, but may comprise electrical connection, no matter directly or indirectly. The words "upper", "lower", "left", "right" and the like are only used to denote a relative positional relationship, and when the described object is changed in its absolute position, this relative positional relationship may also be changed accordingly.

Figure 1:
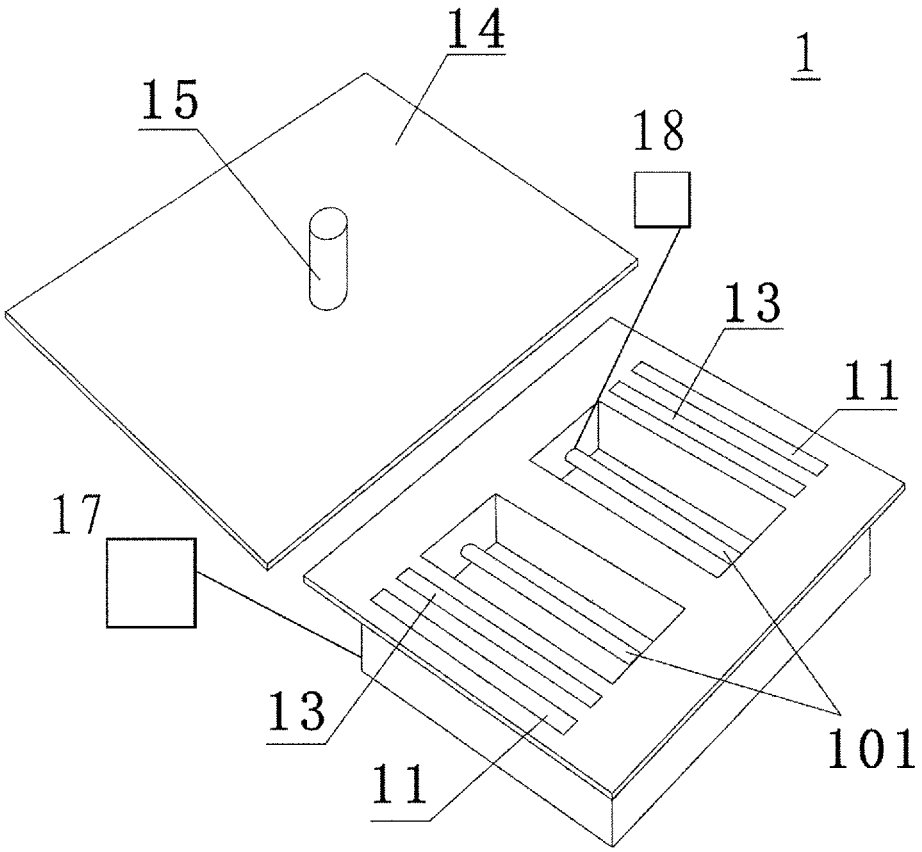
FIG. 1 is a schematic view of a cleaning apparatus provided by the embodiment of present invention.
Figure 2:
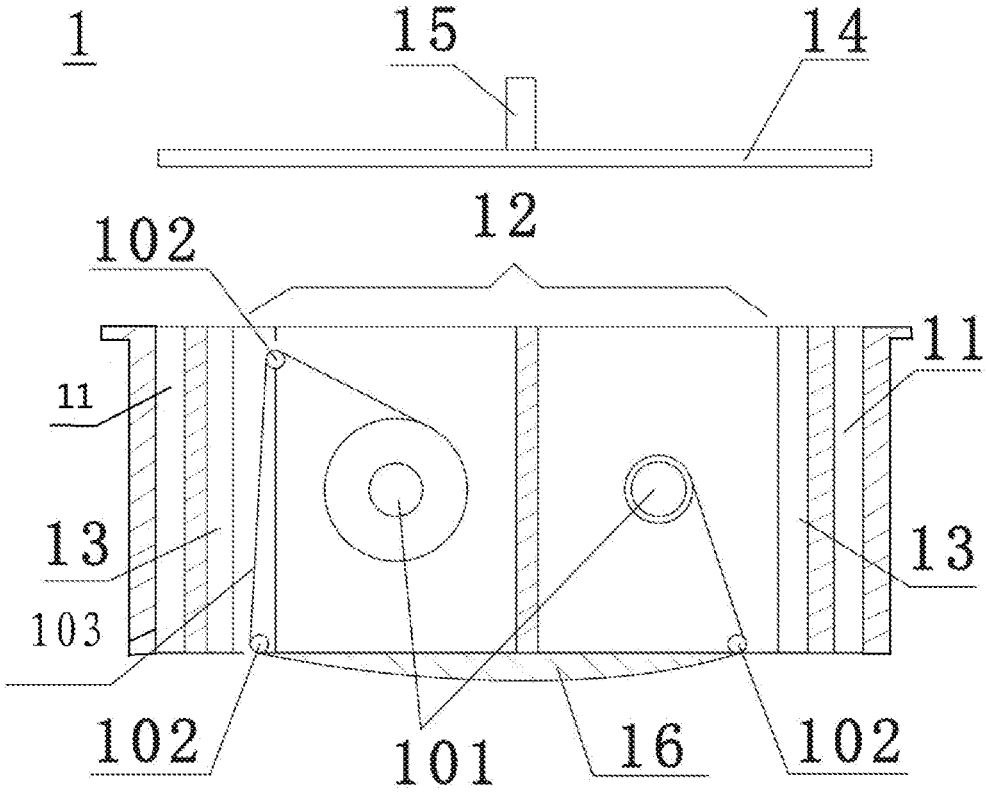
FIG. 2 is a cutaway view of the cleaning apparatus shown in FIG. 1.

As shown in FIGS. 1 and 2, an embodiment of present invention provides a cleaning apparatus 1, comprising at least one dust particulate absorber device(s) 11 and a wiper device 12 arranged in horizontal direction, wherein the at least one dust particulate absorber device(s) 11 is used for absorbing foreign matters, and the wiper device 12 is used for wiping and cleaning.

The cleaning apparatus 1 of the embodiment of present invention may be used to clean any smooth surfaces. For convenience of description, an example, in which the cleaning apparatus 1 is used for cleaning the work table of a detecting device for detection of display panels, is described as following.

Specifically, the at least one dust particulate absorber device(s) 11 and the wiper device 12 are arranged horizontally, that is, each of the dust particulate absorber device 11 is provided at any one of the four perimeter sides around the wiper device 12, and parallel to the wiper device 12 in the horizontal direction. Because the detection of the display panel has a relative high requirement as to the cleanliness of the work table, the cleaning apparatus 1 provided by the embodiment of present invention may also be used for cleaning a work table. The cleaning apparatus 1 provided by the embodiment of present invention may comprise at least one dust particulate absorber device(s) 11 and a wiper device 12, wherein the dust particulate absorber device(s) 11 may be used for preliminary absorption of the foreign matters on the work table, and the wiper device 12 is used to further wipe the work table subsequently. Alternatively, the step of adsorbing the foreign matters on the work table by the dust particulate absorber device 11 may be performed prior to, during, or after the wiping process.

The embodiment of present invention provides a cleaning apparatus 1, which is used to clean the work table on which the display panels are mounted during the detection of the display panels, so as to avoid various potential safety risks and damages to the apparatus caused by manual cleaning. Additionally, the cleanliness level is increased.

For example, in another embodiment of the present invention, as shown in FIGS. 1 and 2, the wiper device 12 may comprise two accommodation chambers, each of which is provided with one roller 101, a sheet of non-dust cloth 103 having its two ends wound around the two rollers 101 respectively, wherein the non-dust cloth 103 at least covers the bottom portion of the cleaning apparatus, and the roller in one of the accommodation chambers is a driving shaft.

To be specified, in an embodiment of present invention, the non-dust cloth 103 may be a sheet of clean cloth, or a sheet of any paper product with proper resilience, or similar items that may be wound around the rollers and used for wiping and cleaning. The non-dust cloth 103 at least covers the bottom of the cleaning apparatus 1. Then, the cleaning apparatus 1 wipes and cleans the work table with the non-dust cloth 103 arranged at the bottom.

For example, in another embodiment of the present invention, as shown in FIG. 2, several feeding shafts 102 may be provided between the two rollers 101 for feeding the non-dust cloth 103. The transfer shafts 102 may be pulleys, slide blocks or similar members.

For instance, in still another embodiment of the present invention, the cleaning apparatus may further comprise an electrical motor module 18 to drive the driving shaft. For example, the electrical motor module 18 may be an electrical motor.

To be specified, the electrical motor module 18 drives the driving shaft, then the section of the non-dust cloth 103 at the bottom of the cleaning apparatus 1 is wound around the driving shaft after wiping. Thus, reuse of the non-dust cloth which would otherwise reduce the clean quality is prevented. To be specified, the used non-dust cloth 103 is wound around the driving shaft by the rotation of the driving shaft while the used non-dust cloth 103 is lifted from the work table. For example, before the cleaning apparatus start to clean the work table or after the cleaning apparatus has wiped part of the work table, the cleaning apparatus is lift up and then the electrical motor module 18 drives the driving shaft. Subsequently, the section of the non-dust cloth have been used to wipe the work table is wound around the driving shaft through rotation of the driving shaft. After this, a section of fresh non-dust cloth 103 is covered at the bottom of the cleaning apparatus to continually clean the work table. Additionally, one of the accommodation chambers with no electrical motor module 18 connected thereto may be filled with cleaning liquid. The cleaning liquid may be water or solution dissolved with rinsing agent, and the rinsing agent is required to be incorrosive and volatile, so as to avoid contamination or damage to the work table and the display panel placed thereon. The dust particulate adsorption device 11 is used to adsorb the dust particulates. The cleaning liquid is used to keep the non-dust cloth 103 wet, and thus the wet non-dust cloth 103 is used to clean tiny dust on the work table, and so on. For example, the cleaning liquid is a volatile solution containing alcohols, for example, isopropanol and the like. Said composition facilitates rapid air drying of the wiped work table.

For example, in another embodiment of the present invention, as shown in FIG. 2, a resilient means 16 may be mounted at the bottom of the cleaning apparatus 1, and the non-dust cloth 103 is arranged to cover the resilient means 16. The resilient means 16 is in a convex configuration, as shown in FIG. 2. The resilient means is in an arcuate shape, such that the bottom of the cleaning apparatus 1 is raised. In addition, while the non-dust cloth 103 overlies the convex resilient means 16, the non-dust cloth 103 may fully contact with the surface of the work table. Thus, the cleanliness after wiping is elevated. For example, the resilient means 16 may be any elastomer, such as sponges, plastic foams, springs, and the like. Moreover, the resilient means 16 may also be disc-shape, square-shape and so on, as long as it can form a protrusive smooth surface so as to support the non-dust cloth 103 for wiping the work table.

For example, at the opposite sides of the wiper device 12 are each provided with one of the at least one dust particulate absorber device(s) 11. As shown in FIG. 2, at each of the left and right sides of the wiper device 12 is provided with one dust particulate absorber device 11.

At the two opposite sides of the wiper device 12 are each provided with one dust particulate absorber device 11. Then, during cleaning process, the cleaning apparatus may start to clean the work table from either side provided with the dust particulate absorber device 11. This is even more convenient. Subsequently, after the cleaning process by above said dust particulate absorber device 11 and the wiper device 12, another absorption process may further be conducted once more by the other dust particulate absorber device 11 to ensure the cleanliness of the work table.

For example, in another embodiment of the present invention, as shown in FIG. 2, the cleaning apparatus further comprises at least one airdry device(s) 13 which is arranged side by side with respect to the wiper device 12 and the dust particulate absorber device(s) 11, and at the two opposite sides of the wiper device 12 is provided with one of the airdry devices 13.

For example, the airdry device(s) 13 is arranged side by side with respect to the wiper device 12 and the dust particulate absorber device(s) 11, that is, they are arranged at the same horizontal plane. Because the non-dust cloth is soaked with cleaning liquid, the work table is wet after wiping process by the non-dust cloth of the wiper device 12. After the wiping process, the work table may be dried faster with the airdry device(s) 13. For example, there are two airdry devices 13, each of which is provided at one of the two opposite sides of the wiper device 12. In another example, the airdry devices 13 are each provided between the wiper devices 12 and the dust particulate absorber devices 11, and may also be provided at the outer sides of the dust particulate absorber devices 11. During each cleaning process by the cleaning apparatus, the dust particulate absorber device 11 at one side of the wiper device 12 and the airdry device 13 at the other side of the wiper device 12 could clean the work table simultaneously.

For example, in another embodiment of the present invention, the dust particulate absorber device(s) 11 communicates to the outside of the device, such that its possible to remove the absorbed dust particulates outside of the cleaning apparatus. Because the cleaning apparatus 1 has a small inner volume, the dust particulates absorbed by the dust particulate absorber device 11 may be removed outside of the cleaning apparatus, there is no need to frequently clean the dust particulates absorbed by the dust particulate absorber device. Accordingly, the cleaning effect is improved, the cleaning procedure is simplified, and the manpower and working hours required are reduced.

For example, in another embodiment of the present invention, the cleaning apparatus further comprises a control circuit 17 for controlling various components of the cleaning apparatus. The control circuit 17 is used to control each component of the cleaning apparatus in the cleaning operations. For example, the control circuit 17 may control the operations of the dust particulate absorber device(s) 11, the electrical motor module 18, the airdry device(s) 13 and the like, and thus further facilitate the manipulation and control of the cleaning apparatus. For example, the control circuit 17 may control the electrical motor module 18, and thus control the rotation of the driving shaft to feed and replace the non-dust cloth 103. The control circuit 17 may also control on and off of the dust particulate absorber device(s) 11 and the airdry device(s) 13, so as to coordinate the operations of the components to clean the work table with higher efficiency.

For example, in another embodiment of the present invention, the cleaning apparatus may further comprise a fixture member 15 for retaining the cleaning apparatus 1. To be specified, the fixture member 15 is used for fixing the cleaning apparatus 1. The fixture member 15 may be integrally formed with the cleaning apparatus. Alternatively, as shown in FIGS. 1 and 2, the fixture member 15 is provided on the top lid 14 of the cleaning apparatus. Alternatively, the top lid 14 may also be formed in any other shape and configuration. The top lid 14 is described here with reference to the drawings as an example.

In the embodiment of present invention, the cleaning apparatus 1 is mainly used to clean the detecting work table. Before cleaning the work table, the cleaning apparatus 1 may, with the fixture member 15, be fixed onto a connecting rod of the detecting device, which is used to fasten a detecting sensor. The cleaning apparatus 1 is controlled to clean the work table through the control circuit 17. For example, as required, the cleaning apparatus 1 could be controlled to move on the work table along a straight, a S-shape, or a W-shape route and the like by the control circuit 17, so as to ensure the cleanliness of the wiped work table.

All the above are just specific embodiments of the present invention, but the scope of the present invention is not limited thereto, and various changes and alternation can be easily obtained by the skilled in this art within the disclosed technical scope by this invention, all of which should be encompassed in the protection reach of the present invention. Hence, the protection scope of the present invention should be accord with the protection scope of the claims.

The invention claimed is:

1. A cleaning apparatus comprising at least one dust particulate absorber device and a wiper device arranged in a horizontal direction, wherein the at least one dust particulate absorber device is used for absorbing foreign matters, the wiper device is used for wiping;

wherein the wiper device comprises two accommodation chambers, each of which is provided with one roller, a sheet of wiping cloth having its two ends wound around the two rollers respectively, wherein the sheet of wiping cloth at least covers the bottom portion of the cleaning apparatus, and the roller in one of the accommodation chambers is a driving shaft;

wherein the cleaning apparatus further comprises an electrical motor module to drive the driving shaft; and wherein one of the accommodation chambers with no electrical motor module connected thereto is filled with cleaning liquid to keep the wiping cloth winding around the roller wet;

wherein the cleaning apparatus further comprises two airdry devices, which are arranged side by side with respect to the wiper device and the at least one dust particulate absorber device, wherein each of the two opposite sides of the wiper device is respectively provided with one of said airdry device;

wherein the dust particulate absorber device, the wiper device, and the airdry devices are each in a substantially cuboid shape, which has the same vertical height.

2. The cleaning apparatus according to claim 1, wherein several transfer shafts are provided between the two rollers for feeding the wiping cloth.

3. The cleaning apparatus according to claim 2, wherein a resilient means is mounted at the bottom of the cleaning apparatus, and the wiping cloth overlies the resilient means.

4. The cleaning apparatus according to claim 2, wherein at the opposite sides of the wiper device are respectively provided with one of the at least one dust particulate absorber device.

5. The cleaning apparatus according to claim 1, wherein a resilient means is mounted at the bottom of the cleaning apparatus, and the wiping cloth overlies the resilient means.

6. The cleaning apparatus according to claim 5, wherein at the opposite sides of the wiper device are respectively provided with one of the at least one dust particulate absorber device.

7. The cleaning apparatus according to claim 1, wherein at the opposite sides of the wiper device are respectively provided with one of the at least one dust particulate absorber device.

8. The cleaning apparatus according to claim 1, wherein the at least one dust particulate absorber device is communicated with the outer side of the cleaning apparatus so as to remove the absorbed dust particulates outside of the cleaning apparatus.

9. The cleaning apparatus according to claim 1, wherein the cleaning apparatus further comprises a control circuit for controlling the operation of each component of the cleaning apparatus.

10. The cleaning apparatus according to claim 1, wherein the cleaning apparatus further comprises a fixture member for fixing the cleaning apparatus.

* * * * *